US007429022B2

(12) United States Patent
Vetesnik

(10) Patent No.: US 7,429,022 B2
(45) Date of Patent: Sep. 30, 2008

(54) MANHOLE COLLAR FOR SUPPORTING A DAVIT

(75) Inventor: Jan Vetesnik, Winnipeg (CA)

(73) Assignee: Capital Safety Group Winnipeg Ltd., Winnipeg, Manitoba (CA)

( * ) Notice: Subject to any disclaimer, the term of this patent is extended or adjusted under 35 U.S.C. 154(b) by 440 days.

(21) Appl. No.: 10/941,074

(22) Filed: Sep. 15, 2004

(65) Prior Publication Data

US 2006/0054773 A1 Mar. 16, 2006

(51) Int. Cl.

| | |
|---|---|
| ***A47B 96/06*** | (2006.01) |
| ***A47G 29/00*** | (2006.01) |
| ***A47K 1/00*** | (2006.01) |
| ***E04G 5/06*** | (2006.01) |

(52) U.S. Cl. ..... 248/218.4; 404/26

(58) Field of Classification Search ..... 404/26; 248/218.4

See application file for complete search history.

(56) References Cited

U.S. PATENT DOCUMENTS

| | | | | |
|---|---|---|---|---|
| 5,211,504 | A * | 5/1993 | Trudel | 404/26 |
| 5,344,253 | A * | 9/1994 | Sacchetti | 404/26 |
| 5,564,855 | A * | 10/1996 | Anderson | 404/26 |
| 5,944,442 | A * | 8/1999 | Roush et al. | 404/26 |
| 6,344,137 | B1 * | 2/2002 | Chiang | 210/164 |
| 6,520,713 | B2 * | 2/2003 | Sondrup | 404/26 |
| 6,524,026 | B2 * | 2/2003 | Sondrup | 404/26 |
| 6,695,526 | B2 * | 2/2004 | Sondrup | 404/26 |
| 6,997,639 | B2 * | 2/2006 | Nadasde | 404/26 |

OTHER PUBLICATIONS

Specifications for "UCL Safety Systems Manhole Collar", UCL Safety Systems, 2 pages (Sep. 17, 1999).

* cited by examiner

*Primary Examiner*—Amy J. Sterling
(74) *Attorney, Agent, or Firm*—IPLM Group, P.A.

(57) ABSTRACT

A manhole collar for mounting in a manhole is defined by a tube with rigid strips shaped to form lobes welded around the upper edge with a bottom edge of each lobe for engaging the ground or other surface around the manhole. A support sleeve is mounted on the tube in a recessed notch at an angular location thereon defining a cylindrical receptacle to hold a post standing up from the manhole for a davit or the like. The sleeve extends partly into the tube and partly outwardly and on the outside is supported by one of the lobes and on the inside by a planar chordal gusset plate. The sleeve includes a cylindrical bushing and a clamping pin for clamping the post in the sleeve engaging through a hole in the sleeve against an outer surface of the cylindrical bushing so that threaded adjustment of the pin causes an end of the pin to press against the cylindrical bushing and divert the bushing inwardly.

23 Claims, 2 Drawing Sheets

FIG. 1
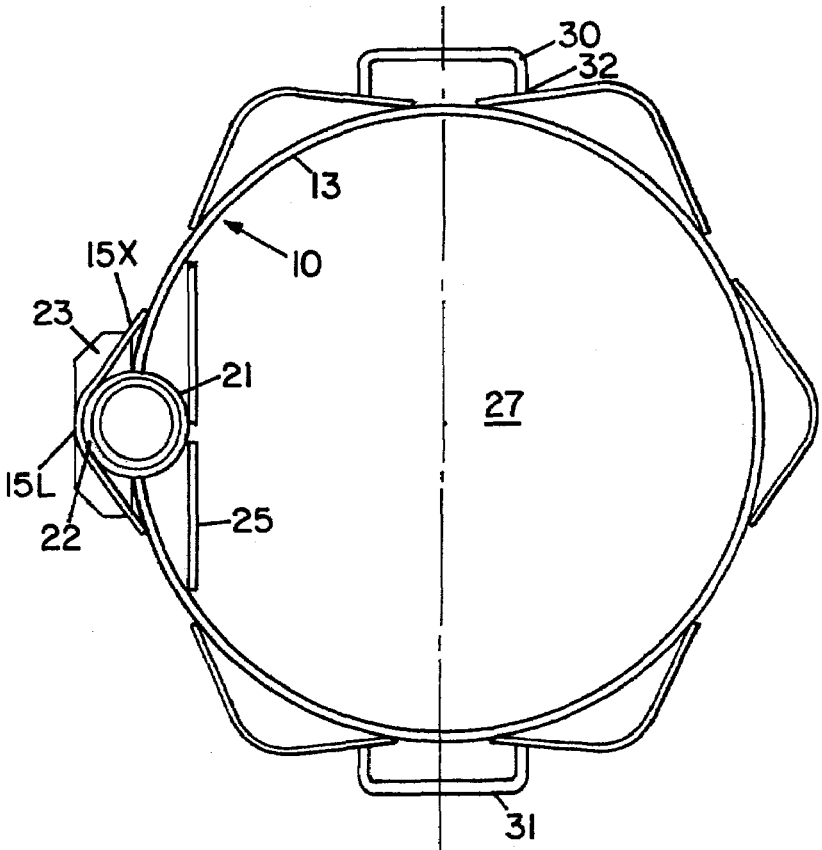
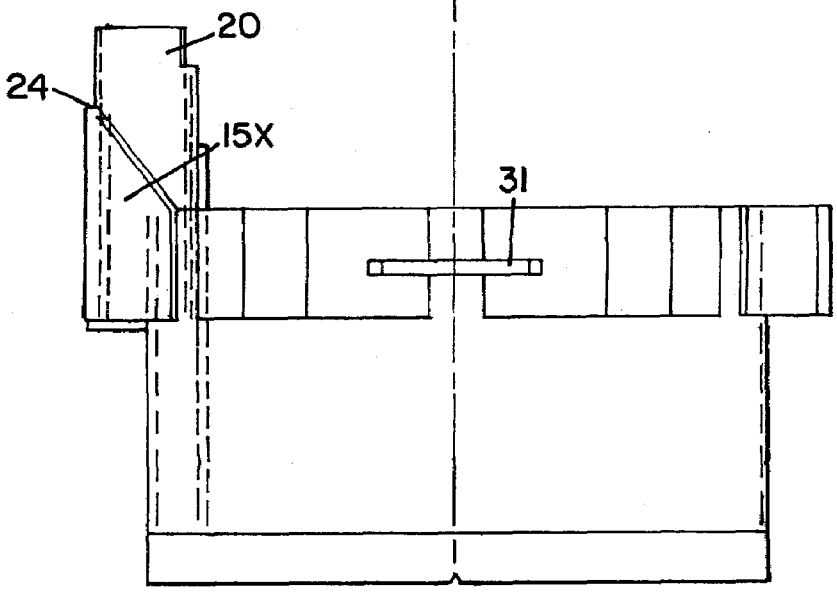
FIG. 2

FIG. 3
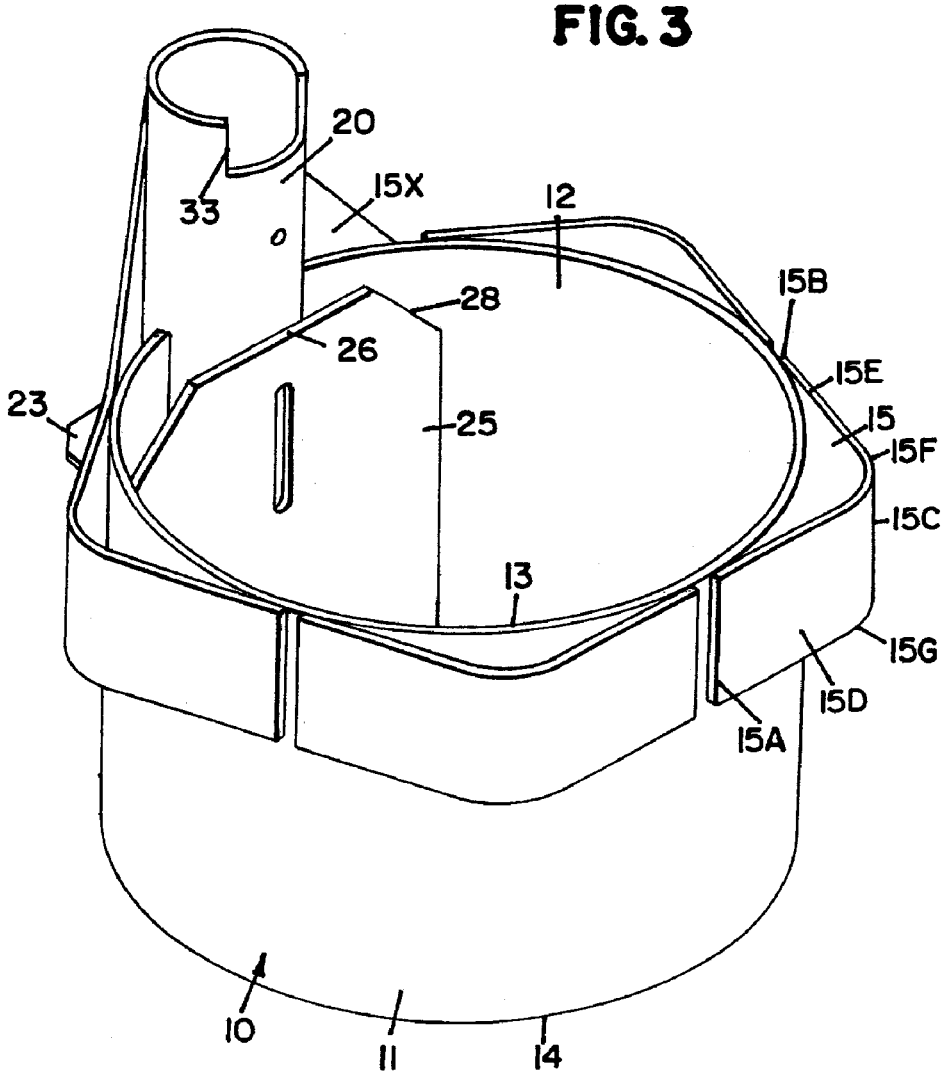
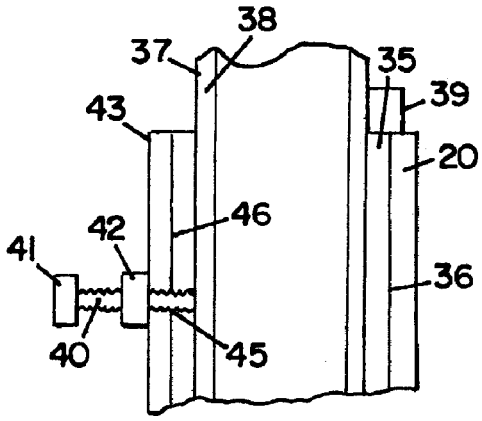
FIG. 4

MANHOLE COLLAR FOR SUPPORTING A DAVIT

This invention relates to a manhole collar for supporting at the manhole a post or other structure such as a davit by which an operator or other materials can be lifted through the manhole.

BACKGROUND OF THE INVENTION

It is known to provide a mounting collar which attaches to a manhole first to provide a support for a post by which various elements can be attached to the manhole. The device is shown in a brochure by the present assignee which provides some details of the manhole collar.

Basically the manhole collar of the prior art comprises a tube around which is welded a horizontal annular ring adjacent the top of the tube so that the tube can be inserted into the manhole with the rim of the manhole surrounding the tube and the horizontal flange or ring of the tube sitting on the rim of the manhole or on the ground or other support surface surrounding the manhole. Thus the structure can be simply dropped into the hole and provides a stable support. On the annular ring at one point around the periphery of the tube is attached a vertical sleeve which is designed to receive a post. The sleeve is braced by a pair of gusset plates which extend from the sides of the sleeve over the upper open end of the tube and into the tube so as to extend generally radially inwardly to the center of the tube. The sleeve is thus mounted outside the tube with the gussets extending into the tube.

This arrangement has achieved considerable success and has satisfied the requirements for a mounting arrangement of this type but is open to significant improvement.

SUMMARY OF THE INVENTION

It is one object of the invention to provide an improved collar for mounting in a manhole for supporting a post or other structure such as a davit.

According to one aspect of the invention there is provided a manhole collar for mounting in a manhole, defined by a generally circular rim surrounding a hole with a peripheral support surface surrounding the rim, and for providing support to an element located at the manhole comprising:

- a hollow cylindrical tube dimensioned so as to be inserted into the hole of the manhole co-axially therewith and with an outer surface of the cylindrical member closely adjacent the rim of the manhole and with a hollow interior through which material can pass into and out of the manhole;
- the tube having an upper circular edge arranged to be located adjacent the rim of the manhole and a lower circular edge arranged such that the outer surface projects into the hole of the manhole to locate the lower circular edge below the rim of the manhole;
- the tube having peripheral support surface engaging components thereon attached thereto and extending outwardly from the outer surface thereof at a position thereon adjacent the upper edge and spaced from the lower edge for engaging the peripheral support surface around the manhole;
- and a support sleeve mounted on the tube at an angular location thereon defining a cylindrical receptacle coaxial with the axis of the tube for a post to hold the post standing up from the manhole;
- wherein the peripheral support surface engaging components comprise a plurality of separate components each attached separately to the outer surface of the tube at angularly spaced positions around the periphery.

Preferably each separate component comprises a rigid strip attached at each end to the outer surface and shaped to divert away from the outer surface between the ends such that one side edge of the strip faces downwardly and acts to engage the support surface. However other shapes and arrangements of individual separate components separately attached around the periphery can be used.

Preferably the strip is metal and is welded to the metal tube at its ends.

Preferably the strips are attached and shaped so that they include adjacent each end a portion which is generally tangential to the outer surface and a curved section coupling the end portions to form a lobe shape.

Preferably the end of each strip is arranged adjacent the end of the next adjacent strip.

Preferably the top edge of each strip is substantially coplanar with the upper edge of the tube.

Preferably there are provided two handles at diametrically spaced locations wherein the handles are attached to two of the components.

Preferably the support sleeve is recessed into the upper edge of the tube so as to partly project inwardly from the tube and partly project outwardly of the tube. The cut out portions necessary to provide the recessing of the sleeve into the edge of the tube can be provided by cutting a notch in the tube or by cutting a slot in the sleeve. The notch may be rectangular to just receive the shape of the sleeve or may be just a part of the tube cut away to leave space for the sleeve.

Preferably the support sleeve has an outer surface butting against an inner surface of one of the separate components.

Where each separate component comprises a rigid strip or lobe attached to the outer surface and shaped to divert away from the outer surface, the support sleeve is arranged to be preferably received within the portion which diverts away from the outer surface and butting against an inner surface thereof.

Preferably a bottom of the sleeve is coplanar with a the side edge of the strip.

Preferably there is provided a supporting gusset connecting the inwardly projecting part of the sleeve to the inner surface of the tube, where the supporting gusset is planar and lies on line which is a chord of the tube.

Preferably the sleeve includes a cylindrical bushing therein of a plastics material allowing free rotation of the post in the sleeve, where the sleeve includes a clamping member for clamping the post in the sleeve, the clamping member comprising a screw threaded pin engaging through a hole in the sleeve against an outer surface of the cylindrical bushing so that threaded adjustment of the pin causes an end of the pin to press against the cylindrical bushing and divert the bushing inwardly.

According to a second aspect of the invention there is provided a manhole collar for mounting in a manhole, defined by a generally circular rim surrounding a hole with a peripheral support surface surrounding the rim, and for providing support to an element located at the manhole comprising:

- a hollow cylindrical tube dimensioned so as to be inserted into the hole of the manhole co-axially therewith and with an outer surface of the cylindrical member closely adjacent the rim of the manhole and with a hollow interior through which material can pass into and out of the manhole;

the tube having an upper circular edge arranged to be located adjacent the rim of the manhole and a lower circular edge arranged such that the outer surface projects into the hole of the manhole to locate the lower circular edge below the rim of the manhole;

the tube having peripheral support surface engaging components thereon attached thereto and extending outwardly from the outer surface thereof at a position thereon adjacent the upper edge and spaced from the lower edge for engaging the peripheral support surface around the manhole;

and a support sleeve mounted on the tube at an angular location thereon defining a cylindrical receptacle coaxial with the axis of the tube for a post to hold the post standing up from the manhole;

wherein the support sleeve is recessed into a notch formed in the upper edge of the tube so as to partly project inwardly from the tube and partly According to a third aspect of the invention there is provided a manhole collar for mounting in a manhole, defined by a generally circular rim surrounding a hole with a peripheral support surface surrounding the rim, and for providing support to an element located at the manhole comprising:

a hollow cylindrical tube dimensioned so as to be inserted into the hole of the manhole co-axially therewith and with an outer surface of the cylindrical member closely adjacent the rim of the manhole and with a hollow interior through which material can pass into and out of the manhole;

the tube having an upper circular edge arranged to be located adjacent the rim of the manhole and a lower circular edge arranged such that the outer surface projects into the hole of the manhole to locate the lower circular edge below the rim of the manhole;

the tube having peripheral support surface engaging components thereon attached thereto and extending outwardly from the outer surface thereof at a position thereon adjacent the upper edge and spaced from the lower edge for engaging the peripheral support surface around the manhole;

and a support sleeve mounted on the tube at an angular location thereon defining a cylindrical receptacle coaxial with the axis of the tube for a post to hold the post standing up from the manhole;

wherein the sleeve includes a cylindrical bushing therein of a plastics material allowing free rotation of the post in the sleeve;

and wherein the sleeve includes a clamping member for clamping the post in the sleeve, the clamping member comprising a screw threaded pin engaging through a hole in the sleeve against an outer surface of the cylindrical bushing so that threaded adjustment of the pin causes an end of the pin to press against the cylindrical bushing and divert the bushing inwardly.

BRIEF DESCRIPTION OF THE DRAWINGS

One embodiment of the invention will now be described in conjunction with the accompanying drawings in which:

FIG. 1 is a top plan view of a manhole collar according to the present invention.

FIG. 2 is a side elevation view of the manhole collar of FIG. 1.

FIG. 3 is an isometric view of the manhole collar of FIG. 1.

In the drawings like characters of reference indicate corresponding parts in the different figures.

FIG. 4 is a cross-section view of a sleeve of the manhole collar of FIG. 1 and a post.

DETAILED DESCRIPTION

The embodiment disclosed in the Figures comprises a tube 10 which defines a cylinder with an outer cylindrical surface 11 and an inner hollow cylindrical surface 12. The tube has an upper end 13 which is circular and a lower end 14 which is also circular.

The length of the tube is preferably of the order twelve inches so as to extend though the rim of the manhole so a sufficient extent to resist twisting of the collar within the rim.

Around the upper edge 13 of the tube is provided a plurality of projecting elements 15 which are spaced angularly around the upper edge and project outwardly from the outer surface 11 of the tube. These projecting elements are formed separately by cutting and welding a suitable shaped piece separate from the tube so that the bottom surface of the element can sit on the ground or on a suitable support surface defined by or surrounding the rim of the man hole.

In the embodiment shown, the projecting elements 15 are formed as lobes each formed from a strip of a rigid material which is attached to the outer surface 11. Each strip is cut to length to define ends 15A and 15B and is bent to define a curved portion 15C between tow straight portions 15D and 15E. The strips are welded to the outside surface of the tube so that an upper edge 15F of the strip is coplanar with the upper edge 13. A bottom edge 15G of the strip is therefore spaced downwardly from the upper edge 13. However the width of the strip is significantly less than the depth of the tube so that the lower edge 15G is spaced well away from the bottom edge of the tube.

The curvature at the curved portion 15C has a much smaller radius of curvature than the curvature of the tube so that the two straight portions and the curved portion of each strip form a generally lobe shaped element applied onto the outside surface. The straight portions 15D and 15E are generally tangential to the outside surface of the tube so that the portion 15E is spaced well away from the outside surface. In practice this spacing is preferably of the order of three inches so as to provide a diameter at the curved portions 15C which lie in a common circle surrounding the tube which is sufficiently greater then the diameter of the tube to ensure that the bottom edge 15G of the lobes sits on the rim and/or the support surface surrounding the rim of the manhole with a sufficient extent of engagement to prevent twisting of the collar within the manhole which can cause one side of the collar to tip or tilt into the manhole. Preferably the outside surface of the tube is a relatively close fit within the rim to prevent such twisting but it is of course desirable that the tube be readily dropped into the rim and readily removed so that there is spacing is required. In addition such rim vary in diameter so that a single diameter collar can fit some different manhole sizes but other dimensions of collar maybe necessary to fit larger or smaller manholes are required.

The collar further includes a sleeve 20 which is arranged to receive a post 38 of an accessory to be mounted on the collar. Various types of accessories that are well known include a davit, ladder support post and other elements which are used in association with the manhole and for which the collar provides a suitable support.

The sleeve 20 and the tube 12 are arranged so that the sleeve bridges the edge of the tube at a selected portion around the periphery of the tube. This is preferably a tube by cutting a slot into the sleeve so that the slot sits over the edge of the tube. However cutting of the tube itself can also be effective provided that there is no interference between the elements so that the sleeve is located in position bridging the tube with a portion 21 projecting inwardly from the tube 10 and a portion 22 projects outwardly from the tube 10. The portions are approximately equal so that the wall of the tube passes approximately through the center of the sleeve.

The bottom of the tube is coplanar with the bottom edge 15G of the lobes so that the length of the portion of the sleeve which projects over the wall of the tube is equal to the height of the lobes. A plate 23 is attached across the bottom of the sleeve and particularly the outer portion of the sleeve so that is closes the open bottom end of the sleeve on the exterior of the tube. The plate 23 bridges the open bottom and extends outwardly beyond the open bottom in the angular direction but not in the radial direction where it is coextensive with the sleeve. The plate 23 thus forms a pad to sit on the support surface at the same height as the bottom edge 15G of the lobes.

The dimension of the lobes is arranged so that the portion 22 butts against the curved section 15C of one of the lobes indicated at 15X. Thus the curvature of the lobe is approximately equal to the curvature of the sleeve so that there is a smooth fit between the curved portion 15C and the outside surface of the sleeve. The sleeve is then welded to the lobe 15X. In order to provide additional resistance to twisting of the sleeve relative to the tube, the lobe 15X has a raised section so that its upper edge extends upwardly and in an inclined manner from the top edge 13 of the tube to a position adjacent to the top of the sleeve 20 to form a top edge 24 of the lobe 15X. Thus the welding of the lobe 15X along its full height to the outside portion of the sleeve provides a rigid mounting of the sleeve relative to the tube.

The sleeve 20 is further braced by a gusset plate 25 which lies along a cord of the circle defined by the tube 10. The plate 25 has an upper edge 26 which is coincident with the plane of the top of the tube. The plate 25 extends downwardly to a bottom edge which is at or approximately at the bottom edge of the tube 14. The gusset plate 25 thus cuts off only a small portion of the hollow interior 27 of the tube since it lies along the plane defined by the cord of the tube with the spacing from the wall of the tube equal only to the projection of the inside portion 21 of the sleeve into the interior of the tube. Thus the plate 25 provides a smooth flat planar surface which does not interfere with the passage of persons or materials through the hollow interior of the tube into the manhole. The plate 25 does not provide any edges or surfaces which can hang-up the materials or persons as they pass and for this reason the top edge 26 is chamfered at the sides indicated at 28.

Two handles 30 and 31 are mounted on the exterior of the tube. Each handle is in the form of the loop with ends of the loop as indicated at 32 welded to respective ones of the lobes 15 so the handles lie in a common plane approximately half way down the lobes.

The sleeve 20 provides the support for the tube and thus may have a cut out section 33 facing inwardly into the tube so as to locate a lug or similar abutment of the post to resist angular rotation of the post if required. However in order to allow the post to rotate when required, the sleeve as best shown in FIG. 4 includes a cylindrical bushing 35 which is of a plastics material arranged to contact the inside surface 36 of the sleeve 20 and to provide a bushing between the inside surface 36 and an outside surface 37 of the post 38. The post has a suitable lug 39 which sits on the top surface of the sleeve to allow the rotation. The post can be clamped within the sleeve by a threaded pin 40 with an adjustment head 41 which can be rotated to drive the threaded pin through a nut 42 attached to the outside surface 43 of the sleeve. The pin 40 thus when turned is driven inwardly or outwardly relative to the sleeve so the end face 45 of the pin butts against an outside surface 46 of the bushing 35. Thus, instead of the end of the pin engaging the post itself, the end of the pin pushes on the cylindrical bushing and thus distort the pushing slightly inwardly so that pressure on the post is applies through the thickness of the bushing thus spreading the load and avoiding metal to metal contact. This reduces the possibility of marring of the lower end of the post which can cause corrosion.

The arrangement described above has the following advantages

1. The lobes formed from bent strip material provide support for the structure in the opening replacing the conventional heavy and costly annular flange or annular ring with a much more effective and light weight construction of reduced cost.

2. The support sleeve is recessed inwardly relative to the tube so that it sits partly within the tube thus reducing the outside diameter of the structure for easier transportation and storage. In addition the location of the sleeve bridging the edge of the tube can assist in transferring loads between the sleeve and the tube.

3. The plastic bushing and clamping screw arrangement provides positive locating pf the post at any rotational position as required without the necessity for through holes into the post which can reduce the damage to the post and reduce corrosion of holes or marks.

4. The flat chordal gusset plate provides a smooth entry and passage way through the hollow interior of the tube and reduces the possibility of projecting edges which can cause hang-up of materials or persons as they pass through he hollow interior.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A manhole collar for mounting in a manhole, defined by a generally circular rim surrounding a hole with a peripheral support surface surrounding the rim, and for providing support to an element located at the manhole comprising:

a hollow cylindrical tube dimensioned so as to be inserted into the hole of the manhole co-axially therewith and with an outer surface of the cylindrical member closely adjacent the rim of the manhole and with a hollow interior through which material can pass into and out of the manhole;

the tube having an upper circular edge arranged to be located adjacent the rim of the manhole and a lower circular edge arranged such that the outer surface projects into the hole of the manhole to locate the lower circular edge below the rim of the manhole;

the tube having peripheral support surface engaging components thereon attached thereto and extending outwardly from the outer surface thereof at a position thereon adjacent the upper edge and spaced from the lower edge for engaging the peripheral support surface around the manhole;

and a support sleeve mounted on the tube at an angular location thereon defining a cylindrical receptacle coaxial with the axis of the tube for a port to hold the post standing up from the manhole;

wherein the peripheral support surface engaging components comprise a plurality of separate components each attached separately to the outer surface of the tube at angularly spaced positions around the periphery;

wherein each separate component comprises a rigid strip attached at each end to the outer surface and shaped to divert away from the outer surface between the ends such that one side edge of the strip faces downwardly and acts to engage the support surface;

wherein the strips are attached and shaped so that they include adjacent each end a portion which is generally tangential to the outer surface and a curved section coupling the end portions to form a lobe shape; and wherein the end of each strip is arranged adjacent the end of the next adjacent strip.

2. A manhole collar for mounting in a manhole, defined by a generally circular rim surrounding a hole with a peripheral support surface surrounding the rim, and for providing support to an element located at the manhole comprising:

a hollow cylindrical tube dimensioned so as to be inserted into the hole of the manhole co-axially therewith and with an outer surface of the cylindrical member closely adjacent the rim of the manhole and with a hollow interior through which material can pass into and out of the manhole;

the tube having an upper circular edge arranged to be located adjacent the rim of the manhole and a lower circular edge arranged such that the outer surface projects into the hole of the manhole to locate the lower circular edge below the rim of the manhole;

the tube having peripheral support surface engaging components thereon attached thereto and extending outwardly from the outer surface thereof at a position thereon adjacent the upper edge and spaced from the lower edge for engaging the peripheral support surface around the manhole;

and a support sleeve mounted on the tube at an angular location thereon defining a cylindrical receptacle coaxial with the axis of the tube for a port to hold the post standing up from the manhole;

wherein the peripheral support surface engaging components comprise a plurality of separate components each attached separately to the outer surface of the tube at angularly spaced positions around the periphery; and wherein there are provided two handles at diametrically spaced locations wherein the handles are attached to two of the components.

3. The manhole collar according to claim 2 wherein the support sleeve is recessed into the upper edge of the tube so as to partly project inwardly from the tube and partly project outwardly of the tube.

4. A manhole collar for mounting in a manhole, defined by a generally circular rim surrounding a hole with a peripheral support surface surrounding the rim, and for providing support to an element located at the manhole comprising:

a hollow cylindrical tube dimensioned so as to be inserted into the hole of the manhole co-axially therewith and with an outer surface of the cylindrical member closely adjacent the rim of the manhole and with a hollow interior through which material can pass into and out of the manhole;

the tube having an upper circular edge arranged to be located adjacent the rim of the manhole and a lower circular edge arranged such that the outer surface projects into the hole of the manhole to locate the lower circular edge below the rim of the manhole;

the tube having peripheral support surface engaging components thereon attached thereto and extending outwardly from the outer surface thereof at a position thereon adjacent the upper edge and spaced from the lower edge for engaging the peripheral support surface around the manhole;

and a support sleeve mounted on the tube at an angular location thereon defining a cylindrical receptacle coaxial with the axis of the tube for a port to hold the post standing up from the manhole;

wherein the peripheral support surface engaging components comprise a plurality of separate components each attached separately to the outer surface of the tube at angularly spaced positions around the periphery;

wherein the support sleeve is recessed into the upper edge of the tube so as to partly project inwardly from the tube and partly project outwardly of the tube; and wherein the support sleeve has an outer surface butting against an inner surface of one of the separate components.

5. The manhole collar according to claim 4 wherein each separate component comprises a rigid strip attached at each end to the outer surface and shaped to divert away from the outer surface between the ends such that one side edge of the strip faces downwardly and acts to engage the support surface.

6. The manhole collar according to claim 5 wherein the strip is metal and is welded to the tube at its ends.

7. The manhole collar according to claim 5 wherein the strips are attached and shaped so that they include adjacent each end a portion which is generally tangential to the outer surface and a curved section coupling the end portions to form a lobe shape.

8. The manhole collar according to claim 6 wherein the top edge of each strip is substantially coplanar with the upper edge of the tube.

9. The manhole collar according to claim 4 wherein each separate component comprises a rigid strip attached at each end to the outer surface and shaped to divert away from the outer surface between the ends such that one side edge of the strip faces downwardly and acts to engage the support surface and wherein the support sleeve is received within the portion which diverts away from the outer surface.

10. The manhole collar according to claim 9 wherein a bottom of the sleeve is coplanar with a the side edge of the strip.

11. The manhole collar according to claim 4 wherein there is provided a supporting gusset connecting the inwardly projecting part of the sleeve to the inner surface of the tube.

12. The manhole collar according to claim 11 wherein the supporting gusset is planar and lies on line which is a chord of the tube.

13. A manhole collar for mounting in a manhole, defined by a generally circular rim surrounding a hole with a peripheral support surface surrounding the rim, and for providing support to an element located at the manhole comprising:

a hollow cylindrical tube dimensioned so as to be inserted into the hole of the manhole co-axially therewith and with an outer surface of the cylindrical member closely adjacent the rim of the manhole and with a hollow interior through which material can pass into and out of the manhole;

the tube having an upper circular edge arranged to be located adjacent the rim of the manhole and a lower circular edge arranged such that the outer surface projects into the hole of the manhole to locate the lower circular edge below the rim of the manhole;

the tube having peripheral support surface engaging components thereon attached thereto and extending outwardly from the outer surface thereof at a position thereon adjacent the upper edge and spaced from the lower edge for engaging the peripheral support surface around the manhole;

and a support sleeve mounted on the tube at an angular location thereon defining a cylindrical receptacle coaxial with the axis of the tube for a port to hold the post standing up from the manhole;

wherein the peripheral support surface engaging components comprise a plurality of separate components each attached separately to the outer surface of the tube at angularly spaced positions around the periphery; and wherein the sleeve includes a cylindrical bushing therein of a plastics material allowing free rotation of the post in the sleeve.

14. The manhole collar according to claim 13 wherein the sleeve includes a clamping member for clamping the post in the sleeve, the clamping member comprising a screw threaded pin engaging through a hole in the sleeve against an outer surface of the cylindrical bushing so that threaded adjustment of the pin causes an end of the pin to press against the cylindrical bushing and divert the bushing inwardly.

15. A manhole collar for mounting in a manhole, defined by a generally circular rim surrounding a hole with a peripheral support surface surrounding the rim, and for providing support to an element located at the manhole comprising:

a hollow cylindrical tube dimensioned so as to be inserted into the hole of the manhole co-axially therewith and with an outer surface of the cylindrical member closely adjacent the rim of the manhole and with a hollow interior through which material can pass into and out of the manhole;

the tube having an upper circular edge arranged to be located adjacent the rim of the manhole and a lower circular edge arranged such that the outer surface projects into the hole of the manhole to locate the lower circular edge below the rim of the manhole;

the tube having peripheral support surface engaging components thereon attached thereto and extending outwardly from the outer surface thereof at a position thereon adjacent the upper edge and spaced from the lower edge for engaging the peripheral support surface around the manhole;

and a support sleeve mounted on the tube at an angular location thereon defining a cylindrical receptacle coaxial with the axis of the tube for a post to hold the post standing up from the manhole;

wherein the support sleeve is recessed into the upper edge of the tube so as to partly project inwardly from the tube and partly project outwardly of the tube; and wherein the support sleeve has an outer surface butting against an inner surface of one of the components.

16. The manhole collar according to claim 15 wherein each of the components comprises a rigid strip attached at each end to the outer surface and shaped to divert away from the outer surface between the ends such that one side edge of the strip faces downwardly and acts to engage the support surface and wherein the support sleeve is received within the portion which diverts away from the outer surface.

17. The manhole collar according to claim 16 wherein a bottom of the sleeve is coplanar with the side edge of the strip.

18. A manhole collar for mounting in a manhole, defined by a generally circular rim surrounding a hole with a peripheral support surface surrounding the rim, and for providing support to an element located at the manhole comprising:

a hollow cylindrical tube dimensioned so as to be inserted into the hole of the manhole co-axially therewith and with an outer surface of the cylindrical member closely adjacent the rim of the manhole and with a hollow interior through which material can pass into and out of the manhole;

the tube having an upper circular edge arranged to be located adjacent the rim of the manhole and a lower circular edge arranged such that the outer surface projects into the hole of the manhole to locate the lower circular edge below the rim of the manhole;

the tube having peripheral support surface engaging components thereon attached thereto and extending outwardly from the outer surface thereof at a position thereon adjacent the upper edge and spaced from the lower edge for engaging the peripheral support surface around the manhole;

and a support sleeve mounted on the tube at an angular location thereon defining a cylindrical receptacle coaxial with the axis of the tube for a post to hold the post standing up from the manhole;

wherein the support sleeve is recessed into the upper edge of the tube so as to partly project inwardly from the tube and partly project outwardly of the tube; and wherein there is provided a supporting gusset connecting the inwardly projecting part of the sleeve to the inner surface of the tube.

19. The manhole collar according to claim 18 wherein the supporting gusset is planar and lies on line which is a chord of the tube.

20. A manhole collar for mounting in a manhole, defined by a generally circular rim surrounding a hole with a peripheral support surface surrounding the rim, and for providing support to an element located at the manhole comprising:

a hollow cylindrical tube dimensioned so as to be inserted into the hole of the manhole co-axially therewith and with an outer surface of the cylindrical member closely adjacent the rim of the manhole and with a hollow interior through which material can pass into and out of the manhole;

the tube having an upper circular edge arranged to be located adjacent the rim of the manhole and a lower circular edge arranged such that the outer surface projects into the hole of the manhole to locate the lower circular edge below the rim of the manhole;

the tube having peripheral support surface engaging components thereon attached thereto and extending outwardly from the outer surface thereof at a position thereon adjacent the upper edge and spaced from the lower edge for engaging the peripheral support surface around the manhole;

and a support sleeve mounted on the tube at an angular location thereon defining a cylindrical receptacle coaxial with the axis of the tube for a post to hold the post standing up from the manhole;

wherein the sleeve includes a cylindrical bushing therein of a plastics material allowing free rotation of the post in the sleeve;

and wherein the sleeve includes a clamping member for clamping the post in the sleeve, the clamping member comprising a screw threaded pin engaging through a hole in the sleeve against an outer surface of the cylindrical bushing so that threaded adjustment of the pin causes an end of the pin to press against the cylindrical busing and divert the bushing inwardly.

21. The manhole collar according to claim 2 wherein each separate component comprises a rigid strip attached at each end to the outer surface and shaped to divert away from the outer surface between the ends such that one side edge of the strip faces downwardly and acts to engage the support surface.

22. The manhole collar according to claim 21 wherein the strips are attached and shaped so that they include adjacent each end a portion which is generally tangential to the outer surface and a curved section coupling the end portions to form a lobe shape.

23. The manhole collar according to claim 4 wherein the support sleeve is recessed into the upper edge of the tube so as to partly project inwardly from the tube and partly project outwardly of the tube.

* * * * *